US005136945A

United States Patent [19]

Kawazoe

[11] Patent Number: 5,136,945

[45] Date of Patent: Aug. 11, 1992

[54] PLATE MOUNTING DEVICE FOR IMPRINTERS

[75] Inventor: Kazuteru Kawazoe, Ichihara, Japan

[73] Assignee: B-J Trading Limited, Tokyo, Japan

[21] Appl. No.: 782,676

[22] Filed: Oct. 25, 1991

[30] Foreign Application Priority Data

Nov. 1, 1990 [JP] Japan ..... 2-296853

[51] Int. Cl.[5] ..... B41F 27/00; B41F 27/02

[52] U.S. Cl. ..... 101/389.1; 101/378; 101/383

[58] Field of Search ..... 101/389.1, 382.1, 383, 101/384, 395, 378

[56] References Cited

U.S. PATENT DOCUMENTS 2,774,302 12/1956 Stromme ..... 101/389.1
3,126,825 3/1964 Tofano ..... 101/378
3,531,361 9/1970 Grandinetti ..... 101/395
3,824,927 7/1974 Pugh et al. ..... 101/389.1
4,890,553 1/1990 Turner ..... 101/389.1

FOREIGN PATENT DOCUMENTS 1505548 3/1978 United Kingdom ..... 101/389.1

*Primary Examiner*—Edgar S. Burr
*Assistant Examiner*—Anthony Nguyen
*Attorney, Agent, or Firm*—Morgan & Finnegan

[57] ABSTRACT

A plate mounting device for an imprinter has a magnetized outer surface, and an imprinter plate cylinder having one or a plurality of positioning pin holes provided near a portion near an end of a plate to be mounted on the imprinter plate cylinder. A ferromagnetic base plate is mounted on the imprinter plate cylinder. The ferromagnetic base plate has a plate face provided with pin through-holes which are brought into alignment with the positioning pin holes so as to position a plate. When the base plate is mounted on the imprinter plate cylinder, those of the positioning pin holes which are not used are filled with magnetic pins.

3 Claims, 6 Drawing Sheets

PLATE MOUNTING DEVICE FOR IMPRINTERS

FIELD OF THE INVENTION

This application claims priority under 35 U.S.C. §119 from Japan:Hei 2-296853, filed Nov. 1, 1990.

This invention relaters to a plate mounting device for an imprinter which imprints a part of a main printing on printing paper.

DESCRIPTION OF THE PRIOR ART

Department stores, supermarkets, convenience stores, car dealers, domestic electric products stores, etc. do their business by selling common goods by a number of stores in wide areas. In this business, a number of advertisement leaflets common among their respective stores are used. In distributing these advertisement leaflets, or inserting them in newspapers to deliver them home, the names of their respective stores and advertisements of their own stores, e.g., sale dates, sales periods, are imprinted on the leaflet advertisements. In a rotary press, when a part of such an advertisement leaflet is imprinted, an imprinter is located before or after color printing units for printing the main printing.

In the rotary press of FIG. 10 for example, an imprinter 4 is located before printing units 5. The imprinter imprints paper 3 fed from a web 2 of a reel stand 1, and then the printing units 5 print a main body of a printing in multi-colors, e.g., four colors. Subsequently the ink is dried by a drier 6, and then the printed paper is fed to a folder 7 to be cut in sheets or folded to be discharged.

In the conventional letter press-type imprinter, an imprinting plate is adhered to a plate cylinder with a both-side adhesive tape. FIG. 9 shows an example of mounting a plate onto a plate cylinder. Lines are drawn on the surface of a plate cylinder 8 for positioning a plate 9. The edge of the plate 9 is adhered along a line 10. The adhering position of the plate is determined by which part of a main advertisement printing an imprinting is made on. A required number of the plate 9 are prepared in accordance with a number of imprinting positions. When there are two imprinting positions as examplified in FIG. 9, two sheets 9A, 9B of the plate are prepared.

In imprinting different letters, pictures, etc. on respective units of a divided number of a required number of advertisement leaflets, a plate corresponding to one of the units is adhered to the plate cylinder of an imprinter, and an imprinting is performed.

When the imprinting is finished, the rotary press is paused to peel the plate off the plate cylinder. Then a different plating is adhered to the plate cylinder, and the imprinting is resumed. As a number of imprintings is increased, a time of replacing plates is increased.

In the above-descrived case, the plates replacing operation performed in the press. Consequently the operation of replacing the plates is unefficient. Even when necessary plates are prepared, because of the indispensable steps of adhering and peeling the plates to and off the plate cylinder, much time is taken for the steps especially in the case where many plates have to be replaced. This leads to lower printing efficiency.

After a plate is mounted, an actual imprinting is performed to confirm whether or not the plate is located at its correct position. If the plate is dislocated, the plate is peeled off to be relocated at the correct position. Thus the replacement of the plates consumes much time.

Furthermore, even when small parts of main advertisement leaflets printings are imprinted, plate cylinder full width-sized plates are used, and accordingly the plates are not effectively used. Besides, their large size increases the plate cost and takes a larger storage space for their re-use.

SUMMARY OF THE INVENTION

This invention has been made to solve the above-described problems. An object of this invention is to provide a plate mounting device for an imprinter in which a plate is mounted on the plate cylinder through the intermediary of a base plate.

Another object of this invention is to provide a plate mounting device for an imprinter which allows small-sized base plates to be used.

In order to achieve the above-described objects, this invention relates to a plate mounting device for an imprinter, in which a ferromagnetic base plate with an imprinting plate is mounted on the imprinting plate cylinder having a magnetized outer face, the device comprising the imprinting plate cylinder, whose outer face is magnetized and magnetic sheet attached to the surface thereof; a ferromagnetic base plate having a plate face; one or a plurality of positioning pin holes formed in a portion of the imprinting plate cylinder near an end of a plate mounted thereon; pin through-holes formed in the base plate which are brought into alignment with the positioning pin holes in the imprinting plate cylinder to position the plate; and magnetic pins for filling unused ones of the positioning pin holes.

According to one preferable aspect of this invention, the positioning pin holes are formed in the imprinter plate cylinder in one or a plurality of pairs, the pin through-holes are formed in the base plate in at least one pair, and the pin through-holes are brought into alignment with one of the pairs of the positioning pin holes so as to position the plate at an imprinting part.

According to this invention, a required number of plates can be prepared outside a press. The replacement of the plates can be quickly performed. Consequently a pause of the press can be shortended. Resultantly the printing efficiency is improved, and small lots can be imprinted.

A plurality of different pattern-plates can be mounted on a plate cylinder by one replacement. This is very effective when imprintings are made on a plurality of parts of a main advertisement printing. The dislocation of a plate, incorrect adhesion of a plate, etc. can be checked before a printing operation. Consequently the preparetory operation can be drastically shortened. Necessary minimum sized-plates can be used. Resultantly the plate cost can be reduced, and a storage space for re-uses of the plates can be diminished.

BRIEF DESCRIPTION OF THE DRAWINGS

FIG. 7 is a perspective view of the plate cylinder with plates mounted on;

FIG. 10 is a schematic view of the structure of the rotary press with an imprinter incorporated in.

DETAILED DESCRIPTION OF THE PREFERRED EMBODIMENT

Figure 1:
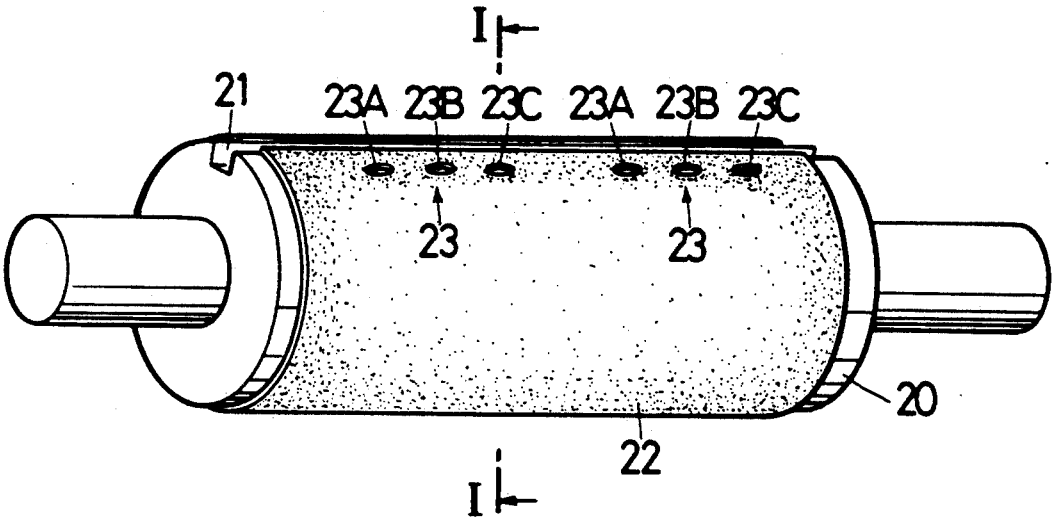
FIG. 1 is a perspective view of the plate cylinder used in an embodiment of this invention.
Figure 2:
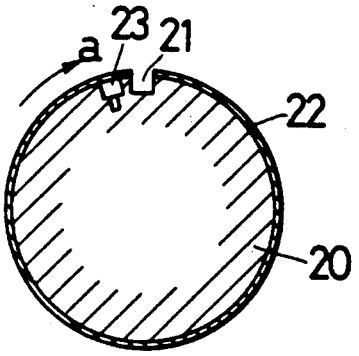
FIG. 2 is a vertical sectional view of the plate cylinder along the line I—I.

An embodiment of this invention will be explained below with reference to the drawings. FIG. 1 shows a preferred embodiment of this invention. In FIG. 1, a plate cylinder body 20 has a plate mounting groove 21 formed in the cylinder surface parallel with the rotation axis thereof. A magnetic sheet 22 is adhered to the part of the cylinder surface except the plate mounting grooves 21. In the portion of the cylinder surface near the plate mounting groove and opposite to a rotational direction of the plate cylinder body (indicated by the arrow "a" in FIG. 2) there are provided positioning pin holes 23 which pass through the magnetic sheet 22 down to a depth which reaches a required depth of the plate cylinder body 20. The positioning pin holes 23 are used to position a base plate 25, which will be described later, when the base plate 25 is mounted on the cylinder plate body. The number of the holes 23 is one or plural.

Figure 3:
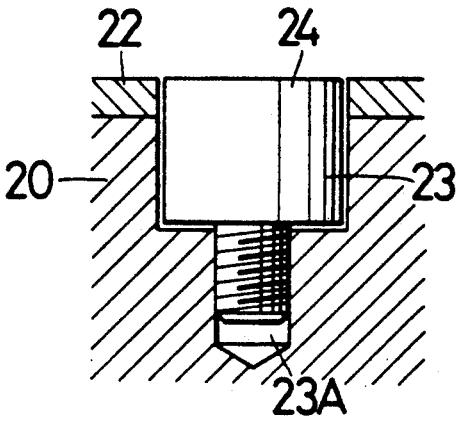
FIG. 3 is a view of a state where positioning pin holes are filled with magnetic pins.

The positioning pin holes 23 are provided in a plurality of pairs, e.g., three pairs (23A, 23B, 23C), at a required interval, depending on plate mounting positions or others corresponding to various sizes of plates, and positions where the plates are imprinted. Those of the positioning pin holes which are not used are filled with magnetic pins 24 as shown in FIG. 3.

Figure 4:
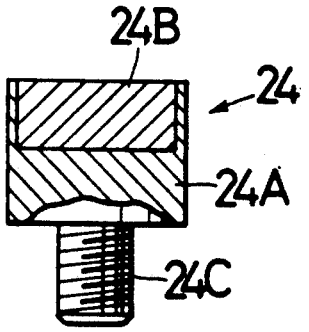
FIG. 4 is a partially broken view of a structure of the magnetic pins.

Each magnetic pin 24 comprises a permanent magnetic 24B secured to a pin body 24A. The magnetic pin 24 shown in FIG. 4 is attached by screw-engaging the thread 24C of the pin body 24A with the thread 23A of a positioning pin hole 23.

At this time a part of the top surface of the permanent magnetic 24B is substantially flush with the surface of the plate cylinder. Resultantly in the vicinity of the end portions of the base plate 25, a loss of a magnetic force of the plate cylinder face due to the pin holes 23 in the magnetic sheet 22 can be supplemented, so that base plate 5 is prevented from floating.

Figure 5:
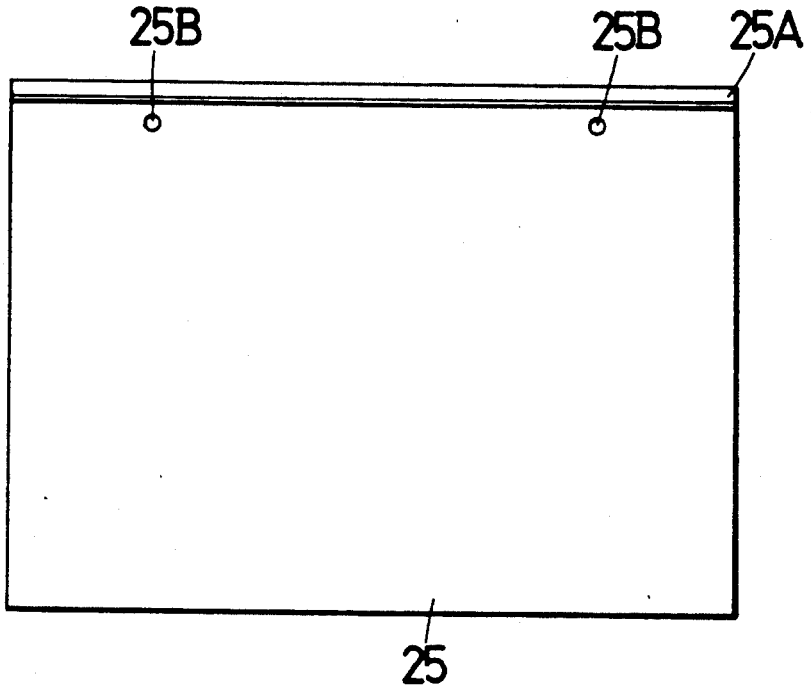
FIG. 5 is a plan view of the base plate for plates.
Figure 6:
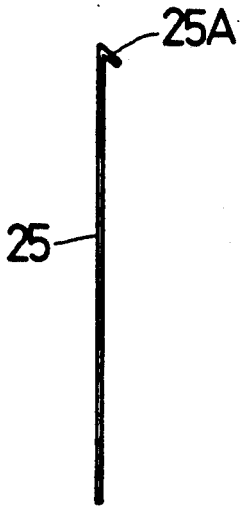
FIG. 6 is a side view of the base plate.

As shown in FIG. 5, the base plate 25 has a required minimum width which is sufficiently smaller, than width of the plate cylinder, and is made of a magnetic material which is attractable by a magnetic force of the magnetic sheet 22. As shown in FIG. 6, the base plate 25 has a bent portion 25A formed on one side thereof to be inserted and locked in a plate mounting groove 21 in the cylinder body. In the portion of the base plate 25 near the bent portion 25A there are provided a pair of pin through-holes 25B along the bent portion 25A. The interval between the pin through-holes 25B of the pair is equal to that between the positioning pin holes 23 of a pair, e.g., the pair 23A.

A required number of sheets of the base plate 25 are prepared before a printing operation is started, and plates 9A, 9B, . . . are adhered beforehand to the surface of the plate cylinder with a both side adhesive tape in accordance with a kind of imprinting and an imprinting position.

Figure 7:
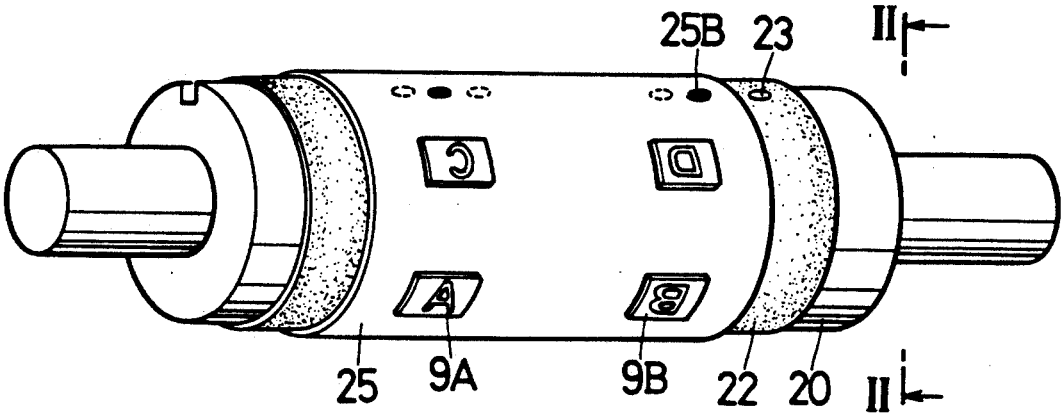
Figure 8:
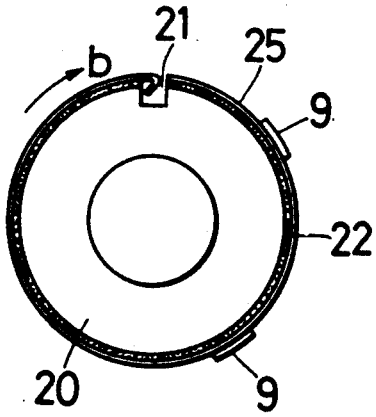
FIG. 8 is a side view of the perspective view of FIG. 7 along the line II—II.
Figure 9:
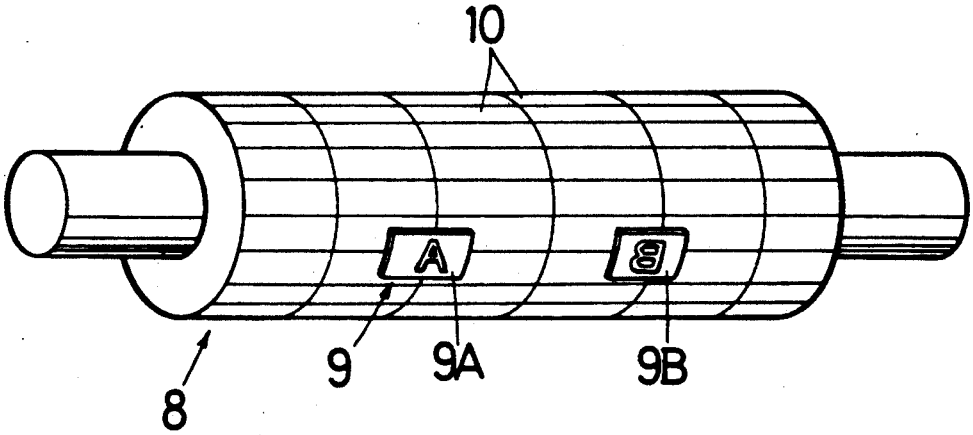
FIG. 9 is a perspective view of a plate cylinder of the conventional imprinter.
Figure 10:
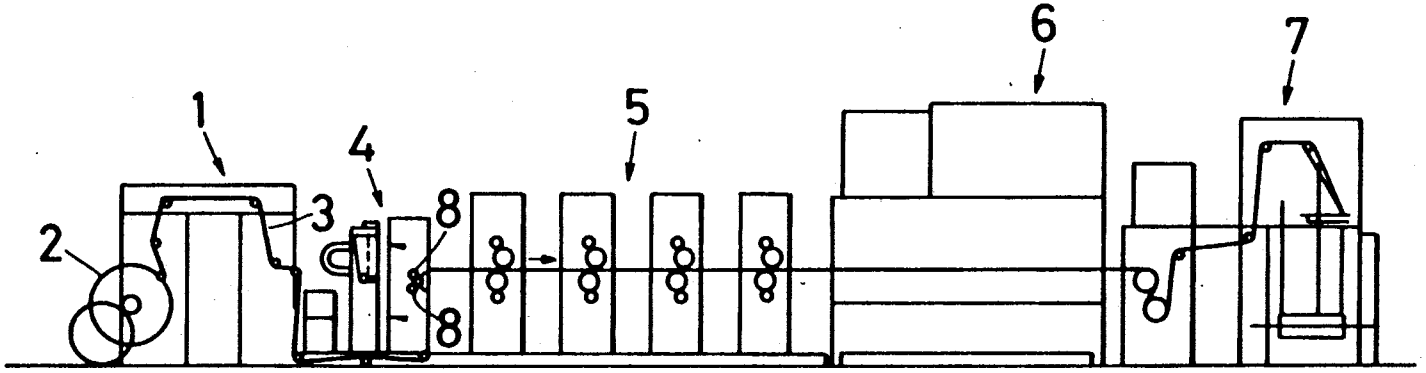

Next, the mounting of the base plate on the plate cylinder body will be explained. FIG. 7 shows the plate cylinder with the base plate mounted on.

A required number of the base plate 25 are prepared in accordance with a number of different imprints, and plates 9A, 9B, . . . are adhered beforehand to the base plates. Those of the pin positioning pins 23 which are not used are filled with the magnetic pins 24. Each base plate with the plates adhered to is suspended by tool pins (not shown) inserted in both pin through-holes 23. Each tool pin is inserted into a positioning pin holes 23 of the plate cylinder body 20 with the plate mounting groove 21 laid horizontal. The bent portion 25A of the base plate is inserted into a plate mounting groove 21 of the plate cylinder. In this state, the base plate 25 is suspended down with the portion near the bent portion attracted by a magnetic sheet 22 and the magnetic pins 24. Then, the plate cylinder body is rotated in the direction indicated by the arrow "b" to wind the suspended base plate onto the plate cylinder and to be attracted by the magnetic sheet.

When a plate is replaced, the portion of the base plate on the side of the bent portion is peeled off, and with the portion held with a hand the plate cylinder body is rotated in the direction indicated by the arrow "b". Then a different base plate is mounted in the above-described way. In this embodiment the plate mounting groove is formed in the plate cylinder, but it is not essential to provide the plate mounting groove. In the latter case, the base plate has no bent portion.

In this invention, the imprinter plate cylinder with the outer surface magnetized is prepared by adhering magnetic sheet to the outer surface of the plate cylinder body but the plate cylinder body per se may be magnetized in place of the magnetic sheet.

What is claimed is:

1. A plate mounting device for an imprinter comprising: an imprinter plate cylinder having a magnetized outer surface, said outer surface having a plurality of positioning pin holes provided therein, said positioning pin holes being located near where an end of an imprinting plate is to be mounted on the imprinter plate cylinder; a ferromagnetic base plate having a plate face with pin through-holes which are positioned in alignment with some of the positioning pin holes of the imprinter plate cylinder; and magnetic pins filling those of the positioning pin holes which are not in use when the base plate is mounted on the imprinter plate cylinder.

2. A plate mounting device for an imprinter according to claim 1, wherein the imprinter plate cylinder has magnetic sheet adhered to the surface thereof beneath said base plate.

3. A plate mounting device for an imprinter according to claim 1, wherein the positioning pin holes are formed in the imprinting plate cylinder in pairs; the pin through-holes are formed in said ferromagnetic base plate in at least one pair; and the pin through-holes are brought into alignment with one of the pairs of the positioning pin holes so as to position the plate at an imprinting location.

* * * * *